United States Patent [19]

Rivinius

[11] 3,961,670

[45] June 8, 1976

[54] HYDRAULIC CONTROL SYSTEM FOR HYDRAULICALLY OPERATED ROAD GRADER

[76] Inventor: Theodore Rivinius, 810 N. 2nd St., Bismarck, N. Dak. 58501

[22] Filed: Mar. 13, 1975

[21] Appl. No.: 557,923

[52] U.S. Cl. ..... 172/4.5; 91/171; 91/411 R; 172/797

[51] Int. Cl.[2] ..... E02F 3/76

[58] Field of Search ..... 172/4.5, 4, 791, 792, 172/793, 795, 796, 797, 800, 804, 805, 806, 809; 37/DIG. 20, DIG. 1; 91/171, 189, 411 R, 413; 404/84

[56] References Cited

UNITED STATES PATENTS

| | | | |
|---|---|---|---|
| 2,636,290 | 4/1953 | Bell | 172/4.5 |
| 2,698,491 | 1/1955 | Felt | 172/809 |
| 2,870,553 | 1/1959 | Temple | 172/809 |
| 2,969,647 | 1/1961 | Raymond | 91/171 |
| 3,495,663 | 2/1970 | Scholl et al. | 172/4.5 |
| 3,543,644 | 12/1970 | Stacey | 91/411 R |
| 3,648,565 | 3/1972 | Probst et al. | 91/171 |
| 3,782,478 | 1/1974 | McRay | 172/4.5 |
| 3,823,646 | 7/1974 | Wadsworth | 91/171 |

*Primary Examiner*—Richard C. Pinkham
*Assistant Examiner*—Richard T. Stouffer
*Attorney, Agent, or Firm*—Dugger, Johnson & Westman

[57] ABSTRACT

A hydraulic control system for use for precise control of the height of the earth working blade on road graders, and in particular for use in combination with road graders that are automatically controlled. The control system is selectively operable, and when engaged will permit only simultaneous movement of the two cylinders used for controlling the depth of the earth working blade.

3 Claims, 2 Drawing Figures

HYDRAULIC CONTROL SYSTEM FOR HYDRAULICALLY OPERATED ROAD GRADER

BACKGROUND OF THE INVENTION

1. Field of the Invention

The present invention relates to control of earth working implements, such as road graders, and in particular, to improvements in hydraulic control systems therefore.

2. Prior Art

Hydraulic control systems for road graders have long been known and used extensively. Usually of course these are double acting hydraulic cylinders with one positioned on each side of the road grader frame, that in turn control the depth, and also the angle or slope of the circle frame that supports the common earth working blade. Hydraulic cylinders are difficult to control for finish work, in particular when automatic depth controls are being utilized, any changes in depth usually results in some change in the slope of the earth working blade as well, thereby minimizing the preciseness of operation of the unit.

SUMMARY OF THE INVENTION

The present invention relates to improvements in hydraulic control systems for use with hydraulic cylinder controlled earth working implements particularly designed to be selectively operable so that both of the hydraulic cylinders normally used for controlling the depth of an earth working blade will be moved precisely the same amount so as to not disturb the slope of the cut during depth changes. The improvements in the hydraulic circuitry herein include flow integrators, which are commonly used elements that combine two separate flows into one and are designed such that without precise ratios between the two flows, one of the flows will be restricted in respect to the other until the ratio equals.

When the system is set to operate in a normal manner, the flow integrators are bypassed, and thus the angle of the blade can be changed in the usual manner, and once the selector is set, when the depth of the blade is changed the blade will be moved parallel to its original setting in that both of the cylinders will move the same amount.

DESCRIPTION OF THE PREFERRED EMBODIMENTS

Figure 1:
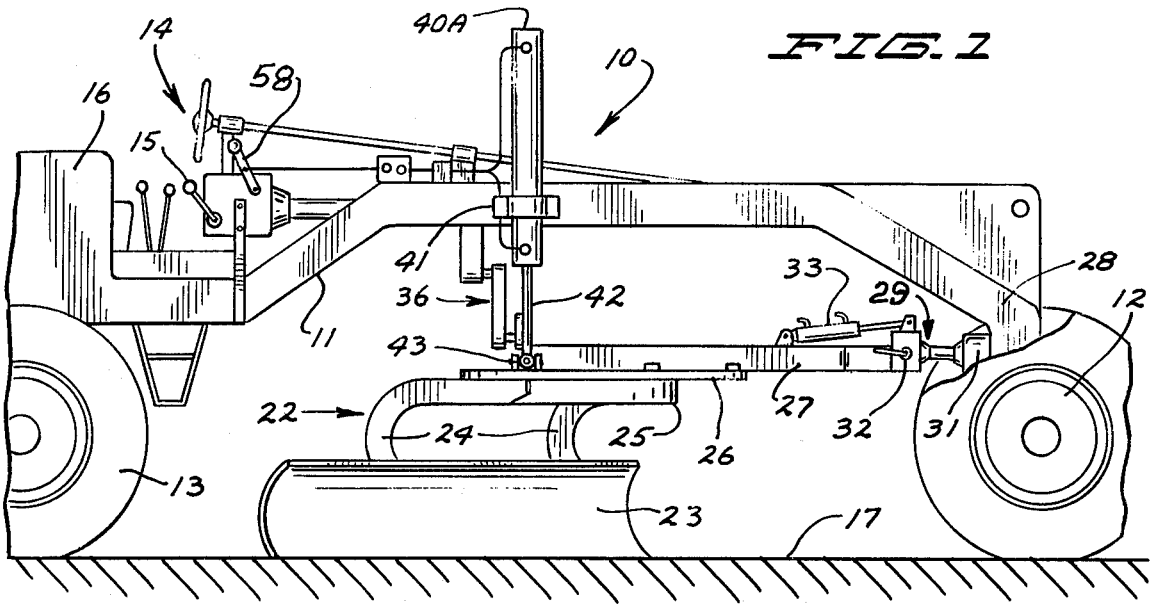
FIG. 1 is a side elevational view of a typical hydraulically controlled road grader showing an earth working blade with hydraulic cylinders attached thereto for raising and lowering.

A road grader illustrated part schematically at 10 is of the usual design having a frame 11, and front wheels 12, and rear propelling wheels 13. An operator control platform illustrated generally at 14 is used for operating controls 15 for the various functions of the grader. A power unit can be mounted in the housing 16 at the rear of the frame.

An earth working blade assembly indicated generally at 22 includes the blade member 23 that is used for working the surface of the ground indicated at 17, and the blade 23 is attached to upright supports 24 which are in turn attached to a circle frame 25 that is rotatably mounted about an upright axis to a circle frame support 26. The circle frame support 26 in turn is attached to a drawbar 27. The drawbar 27 is coupled to the upright member 28 of the frame at the forward end thereof through a drawbar leveling attachment indicated generally at 19. The drawbar leveling attachment is fully disclosed in my U.S. Pat. No. 3,856,089, Issued Dec. 24, 1974 and includes a ball joint assembly 31, that mounts a first portion of the drawbar and a pivot connection 32, between the first short portion of the drawbar and the main portion of the drawbar. A control cylinder 33 controls the angular relationship between the two drawbar portions to permit leveling the circle frame. That is, the plane of the circle frame 25 is maintained exactly horizontal or parallel to the desired cutting plane of the earth surface 17. The controls for the cylinder 33 and the mode of operation are fully disclosed in my U.S. Pat. No. 3,856,089. When the plane of the circle frame is maintained parallel to the desired cutting plane, rotation of the earth working blade 23 about its upright axis when the circle frame is rotated will not disturb the angle of cut of the earth working blade as fully explained in that patent.

The present invention finds particular use in connection with automatic level control of earth working blades, and thus the device for leveling the circle frame which is important for automatic operation is also disclosed herein.

The circle frame 25 is raised and lowered by a pair of double acting hydraulic cylinders 40A and 40B, one being the left side cylinder and one being the right side cylinder. These cylinders are mounted in suitable brackets 41 to the frame 11 of the earth working machine, and the cylinders have longitudinally extendable and retractable rods 42 which are mounted through suitable connections 43 to a cross bar attached to the rear of the drawbar 27. The cylinders are operable under fluid pressure to raise and lower the rear of the drawbar and thus the circle frame 40A or 40B are actuated.

The circle frame also can be moved from side to side by a suitable control cylinder which is illustrated only schematically at 36.

Figure 2:
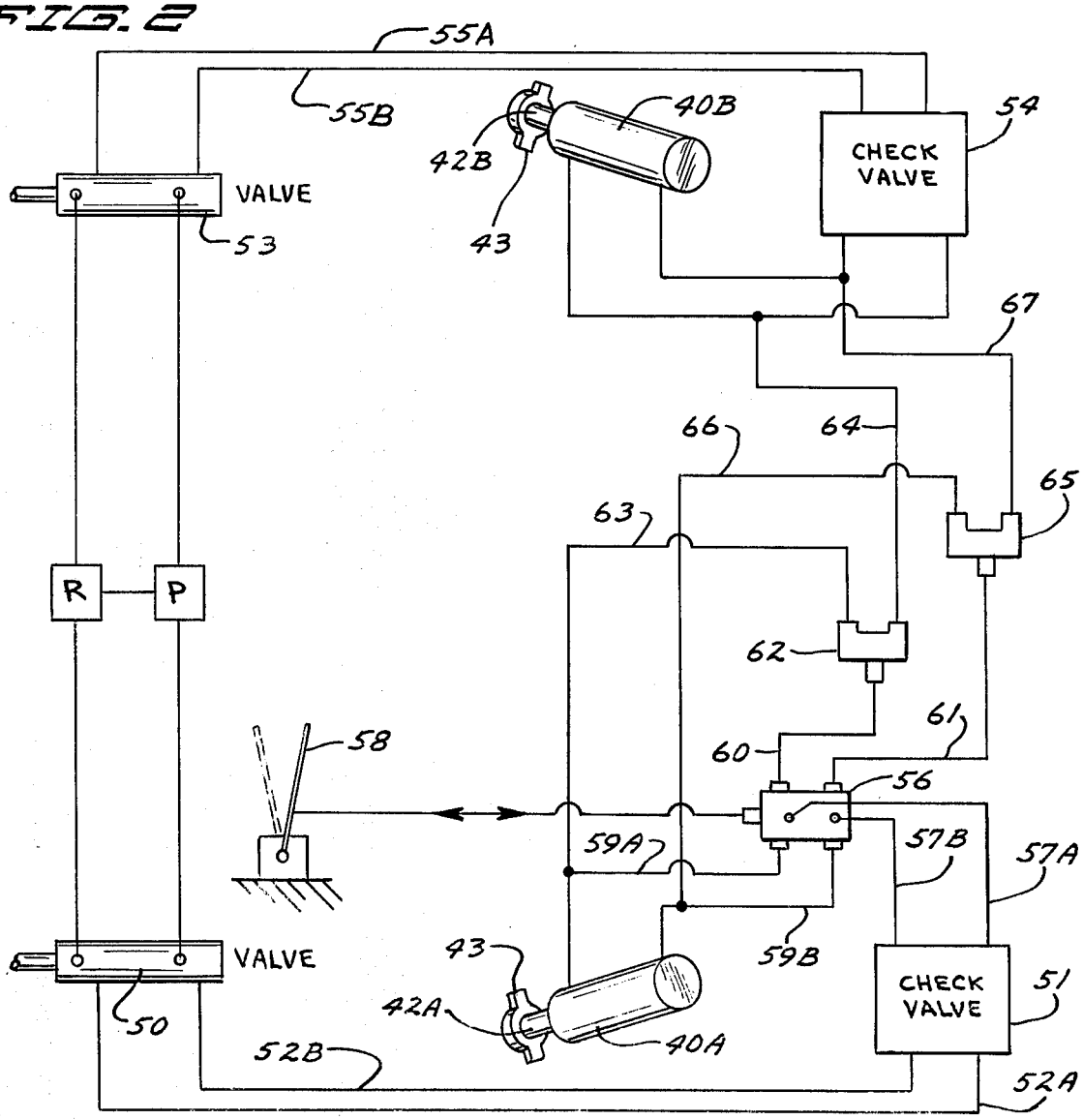
FIG. 2 is a schematic representation of a hydraulic circuit embodying the improved features for control of an earth working blade.

The individual cylinders 40A and 40B are controlled by separate control valves, as shown schematically in FIG. 2. For example, the right lift cylinder 40A is controlled through a four way valve 50 that is connected through a pilot operated check valve 51 and a selector valve 56, as will be more fully explained, to the respective base and rod ends of the cylinder.

The left lift cylinder 40B is controlled by a four way valve 53 that provides pressure through a pair of lines 55A and 55B and through a pilot operated check valve 54 to the respective ends of the cylinder by providing pressure and return through the respective lines 55A and 55B.

When the selector valve is in its normal position there is no fluid interconnection between the two cylinders 40A and 40B and thus the cylinders can be individually raised and lowered by operating the respective valves 50 or 53. This is the normal operation to the unit, and permits changing of the incline of the circle frame and earth working blade 23 as well as the depth. The circle frame pivots about the ball joint at the front of the frame, and with the leveling mechanism 29 installed, the circle frame 25 can be kept substantially parallel to the desired cutting plane.

When the grader is used with an automatic leveling control, generally the valves 50 and 53 would be solenoid operated, and will respond to a level sensor, or to a string line sensor in the conventional manner to keep the blade at a preset depth or cutting angle. Usually when this is done, one of the cylinders will be used for a depth control, that is operating a single cylinder will raise one side of the blade, and then the automatic control will bring the blade back to the desired level by operating the other cylinder. However, in automatic leveling control, and even in manual leveling control it has been found that the changing of the depth setting generally results in lack of precise control between the movements of the two cylinders so that the blade will change in transverse angle or incline. In order to prevent errors in the blade incline from occurring, the present invention has been advanced.

Selector valve 56 is connected by lines 57A and 57B to the check valve 51, and the selector valve has a control handle 58 that controls the spool in the valve so that in one position the lines 57A and 57B will be connected directly to lines 59A and 59B, and then as shown, through T connectors, to the rod and base ends of the cylinder 40A. In this normal position of the selector valve 56 the unit will operate in a normal manner, that is, any operation of the lift valve 50 will merely result in changing the setting of cylinder 40A and operation of the valve 53 will result in changing the setting of cylinder 40B.

The selector 56 has a pair of lines 60 and 61, respectively, connected to, and when control handle 58 is moved to the second position from the selector valve 56, the lines 60 and 61 will be connected to the lines 57A and 57B, respectively. The lines 60 and 61 are blocked by valve 56 with valve 56 in its normal position. Line 60 is connected to the output port of a flow integrator valve 62 which is shown schematically. The flow integrator valve has a pair of inlet lines 63 and 64. The line 63 is connected through a T connection to line 59A and thus directly to the rod end of the cylinder 40A, and the line 64 is connected through a T connection to a line leading to the rod end of the cylinder 40B. The flow integrator valve such as valve 62 are well known, and a flow integrator valve which will operate satisfactorily in this application is one made by Brand Hydraulics, Inc., Omaha, Nebraska, their Model B-300 or Model F1300. The valve is described in their bulletin relating to this model. Briefly, a flow integrator valve is made so that it will combine two streams into one, and does it at a fixed ratio. In the form shown, the flow integrator valve is selected so that each of the input streams or flows coming through lines 63 and 64 to the valve must be equal or an internal spool will shift to insure equality in the flow.

A second flow integrator valve 65 has an integrated output port connected to line 61, and the input ports of the flow integrator valve 65 are connected to lines 66 and 67, respectively, which are connected in turn to the base ends of the cylinders 40A and 40B respectively. When a flow of fluid under pressure is provided through line 60, for example, the single normal output port of the flow integrator valve 62, check valves on the interior of the flow integrator open so that such reverse flow from line 60 will be supplied in parallel to lines 63 and 64 through the internal check valves. However, assuming that selector valve 56 is in its non-normal position so lines 57A and 60 are connected and lines 57B and 61 are also connected, and further assuming that valve 50 has been actuated in a manner to provide pressure through line 52B and check valve 51, and a flow return passage through line 52A, then fluid under pressure will be provided through line 57B to line 61, and this fluid under pressure will be provided through the internal check valves of integrator valve 65 through lines 66 and 67 to the base ends of cylinder 40A and 40B, tending to lower the circle frame and cutting blade. Check valve 54, which is a pilot operated check valve will prevent reverse flow back to valve 53 inasmuch as no pilot pressure is supplied to the input of the check valve.

However, return flow then must come from the rod ends of both cylinders through lines 63 and 64 to the inputs of the flow integrator valve 62. The flows from the two lines must be exactly equal or the flow integrator will adjust to restrict the largest flow to insure that the flows become equal. The combined flows will be discharged through lines 60, 57A and 52A. The exhaust flows from both cylinders thus have to be equal, meaning that the cylinders will have to move an equal amount. The blade control is therefore precise.

Operating the valve 50 in opposite direction will cause retraction of the cylinders by supplying fluid under pressure to line 60 with the return flows from the base ends of the cylinders will be kept precisely equal by the integrator valve 65. The depth of the blade can be changed by operating valve 50, but only if both of the cylinders controlling the depth of the blade change exactly the same amount, which will insure that the slope of the blade will not change.

The left lift cylinder valve 53 is not normally operated when the selector valve is in its position to activate the flow integrator. However, valve 53 may be used to adjust the slope of the blade without damaging the system even when the selector valve is connecting lines 60 and 61 in the circuit.

Thus, by using flow integrators which integrate flow from the exhaust side of the cylinders, and a selector valve to permit selective operation of these flow integrators, precise slope and depth control of the grader blade can be achieved during automatic operation or manual operation for insuring that once a slope has been established it will be maintained if the depth is changed.

The selector valve can be Model DS75 made by Gresen Manufacturing Company, Minneapolis, Minn. The check valves 51 and 54 are pilot operated check valves of conventional design presently on hydraulically operated road grader equipment made by Caterpillar Tractor Co. of Peoria, Ill.

What is claimed is:

1. In combination with an earthworking machine having a pair of double acting cylinders each having a base end and a rod end providable with fluid under pressure for operating an earth working blade, and a separate control valve for each of said cylinders, each control valve having a pair of lines comprising selectively actuable first and second lines for operating the one of said double acting cylinders associated therewith, the improvement comprising a selector valve in fluid communication with the first and second lines of one of said control valves and to the cylinder associated therewith, said selector valve provided with means movable to a first position wherein said first and second lines are in fluid communication with the corresponding cylinder, and a second position wherein said first and second lines from said one control valve will be in fluid communication with separate outlet ports of said selector valve, a first flow integrator valve having a pair of first inlet ports and a first outlet port, said first outlet port being in fluid communication with one of said outlet ports of said selector valve, and said first inlet ports each being in fluid communication with the base end of a different one of said cylinders from the cylinder in fluid communication with the other of said first inlet ports, and a second flow integrator valve having a pair of second inlet ports and a second outlet port, and said second outlet port being in fluid communication with the other of said outlet ports of said selector valve and said second inlet ports being in fluid communication with the rod end of a different one of said cylinders from the cylinder in fluid communication with the other of said second inlet ports, said flow integrator valves each permitting parallel fluid flow in a direction from their respective outlet ports to their respective inlet ports, but preventing substantially dissimilar fluid flow from each of the respective inlet ports to their respective outlet port whereby said flow integrator valves meter the exhaust flows from both of said double acting cylinders to insure equal exhaust flows, and permit parallel operation of said cylinders with substantially equal movement thereof.

2. The combination as specified in claim 1 and manual control means adjacent an operator's platform of said earth working machine for selectively operating said selector valve.

3. The combination as specified in claim 1 and check valve means in each line between said selector valve and the corresponding first mentioned control valve.

* * * * *

UNITED STATES PATENT AND TRADEMARK OFFICE

CERTIFICATE OF CORRECTION

PATENT NO. : 3,961,670

DATED : June 8, 1976

INVENTOR(S) : Theodore Rivinius

It is certified that error appears in the above-identified patent and that said Letters Patent are hereby corrected as shown below:

Title third page and Column 1, lines 2 and 3 "Hydraulic Control System For Hydraulically Operated Road Grader" should be--Hydraulically Operated Earth Working Machine With Hydraulic Control System--. Column 2, line 8 "19" should be--29--. Column 4, line 17 before "inputs" insert--two--.

Signed and Sealed this

Seventeenth Day of August 1976

[SEAL]

*Attest:*

RUTH C. MASON
*Attesting Officer*

C. MARSHALL DANN
*Commissioner of Patents and Trademarks*